US005605205A

United States Patent [19]

Douglas et al.

[11] Patent Number: 5,605,205

[45] Date of Patent: Feb. 25, 1997

[54] READILY DEPLOYABLE PORTABLE ESCAPE LADDER

[75] Inventors: Patrick Douglas; Don Jursich, both of Chicago; Kenneth R. Fenne, Glen Ellyn, all of Ill.

[73] Assignee: BRK Brands, Inc., Aurora, Ill.

[21] Appl. No.: 289,929

[22] Filed: Aug. 12, 1994

[51] Int. Cl.[6] ..... E06C 1/36

[52] U.S. Cl. ..... 182/198; 182/206; 182/70

[58] Field of Search ..... 182/196–199, 182/206, 70

[56] References Cited

U.S. PATENT DOCUMENTS

| | | | |
|---|---|---|---|
| 190,342 | 5/1877 | Lake . | |
| 1,196,419 | 8/1916 | Banyovits . | |
| 1,301,734 | 4/1919 | Patterson . | |
| 1,816,702 | 7/1931 | Small . | |
| 1,859,984 | 5/1932 | Reese . | |
| 2,223,980 | 12/1940 | Zent | 228/40 |
| 2,887,261 | 5/1959 | McGuire | 228/40 |
| 3,033,310 | 5/1962 | McLeod | 182/196 |
| 3,075,612 | 1/1963 | Gould | 182/196 |
| 3,307,654 | 3/1967 | Green et al. | 182/198 |
| 3,315,762 | 4/1967 | Torrey | 182/198 |
| 3,385,399 | 5/1968 | Burt | 182/70 |
| 3,415,341 | 12/1968 | Hostetler | 182/197 |
| 3,696,888 | 10/1972 | Brandenberger | 182/35 |
| 3,727,724 | 4/1973 | Gilbert et al. | 182/198 |
| 3,834,492 | 9/1974 | Ronk | 182/196 |
| 3,858,683 | 1/1975 | Rachocki | 182/156 |
| 3,907,064 | 9/1975 | Svalberg et al. | 182/70 |
| 3,946,834 | 3/1976 | Shafer et al. | 192/164 |
| 4,143,741 | 3/1979 | Souza et al. | 182/198 |
| 4,157,130 | 6/1979 | Aberer | 182/198 |
| 4,243,121 | 1/1981 | Kiss et al. | 182/196 |
| 4,434,871 | 3/1984 | Niedworok | 182/196 |
| 4,531,612 | 7/1985 | Sandor | 182/196 |
| 4,709,783 | 12/1987 | Tomioka et al. | 182/8 |
| 4,867,275 | 9/1987 | Islava et al. | 182/198 |

FOREIGN PATENT DOCUMENTS

| | | | |
|---|---|---|---|
| 614887 | 2/1961 | Canada | 182/196 |
| 471433 | 7/1914 | France | 182/197 |
| 2059544 | 6/1972 | Germany . | |
| 751948 | 7/1980 | U.S.S.R. . | |

OTHER PUBLICATIONS

American LaFrance Advertizing brochure, undated—4 pages.

Dial Safety Ladder Corporation pricing sheet, undated, presumed published prior to Jan. 1, 1993, 1 page.

All–Safe Inc. Fire Escape Ladder Manual, undated 4 pages.

MLM Machine and Metal Products, RES–Q–Ladder Merchandising Ideas, undated, 1 page.

MLM Machine and Metal Products, RES–Q–Ladder Merchandising brochure, undated, 2 pages.

MLM Machine and Metal Products, RES–Q–Ladder Advertising brochure, undated, 4 pages.

MLM Machine and Metal Products, Comparison of 2–Story Fire Escape Ladders, presumed published in or about 1993, 1 page.

MLM Machine Machine and Metal Products, RES–Q–Ladder Price List, dated Dec., 1993, 1 page.

Consumer Reports Article entitled "Fire–Escape Ladders: Making a fast exit easy", Oct. 1991, 1 page.

*Primary Examiner*—Alvin C. Chin-Shue

*Attorney, Agent, or Firm*—Dressler, Goldsmith, Milnamow & Katz

[57] ABSTRACT

A readily deployable, portable escape ladder includes nestable rungs maintained in a releasable, stacked state. The ladder includes a cover having a releasable fastening system which, when released, permits the ladder to move from the stacked state to an extended state. The rungs include integral standoff members to displace the ladder from the surface of a building when deployed. The rungs are spaced one from the other, along a flexible mounting member. The mounting member penetrates the rungs in a staggered orientation.

6 Claims, 7 Drawing Sheets

FIG. 2
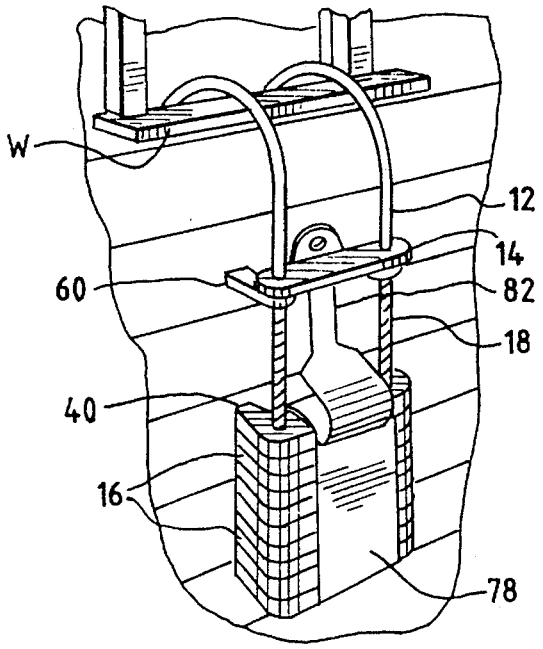
FIG. 3
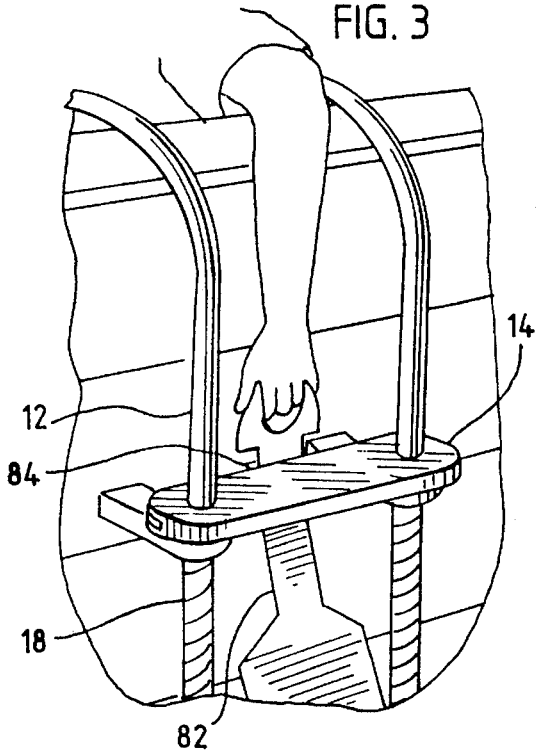
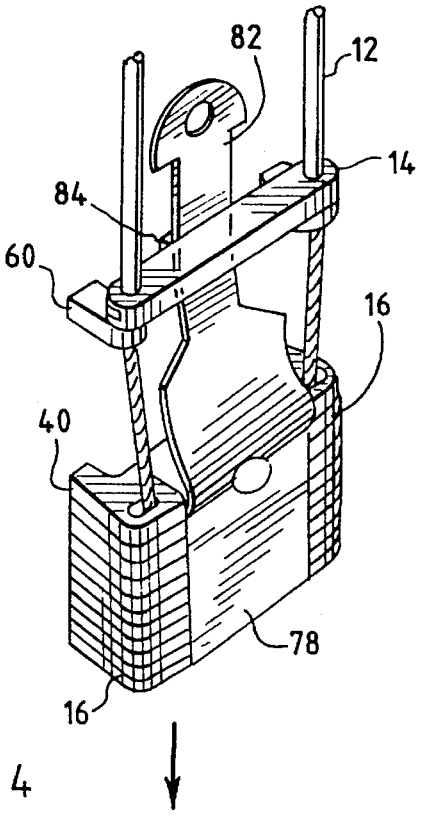
FIG. 4
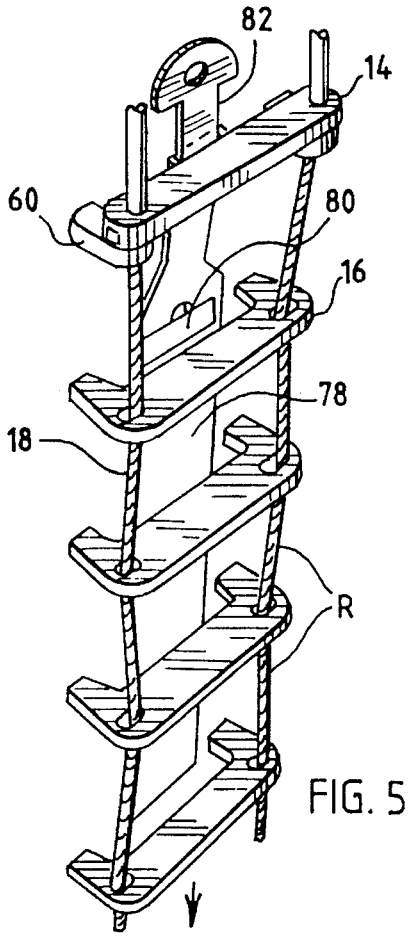
FIG. 5

FIG. 6
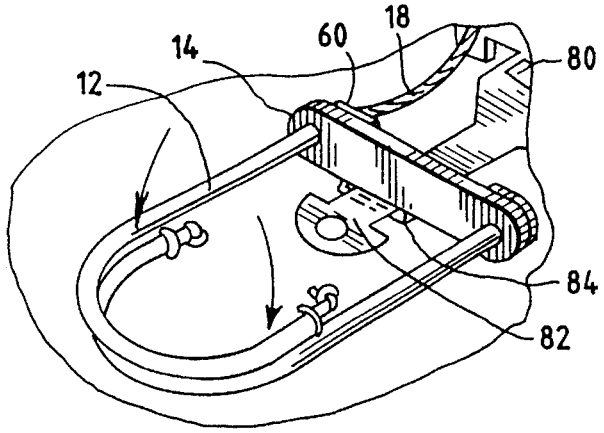
FIG. 7
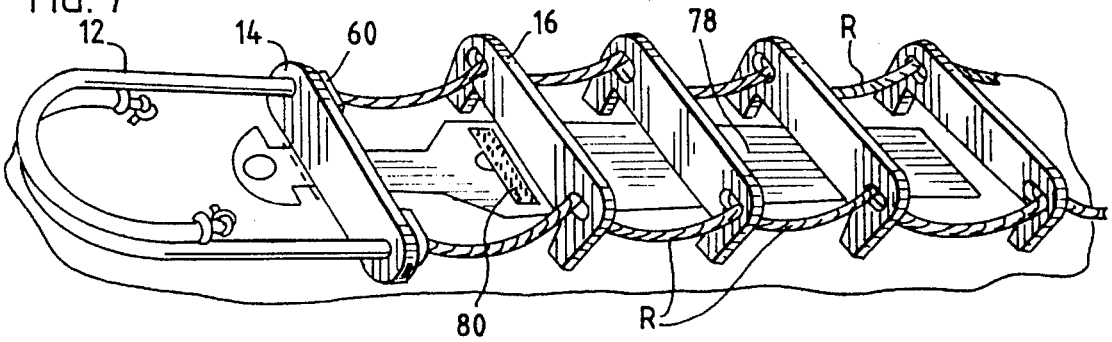
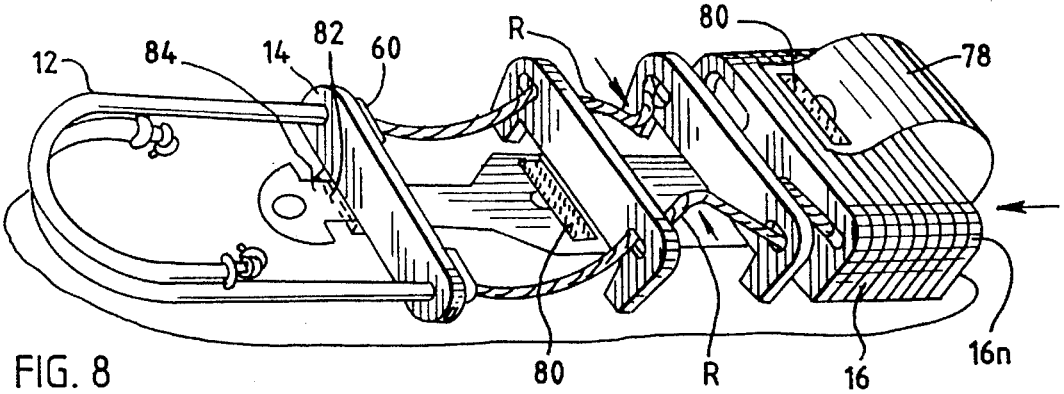
FIG. 8
FIG. 9
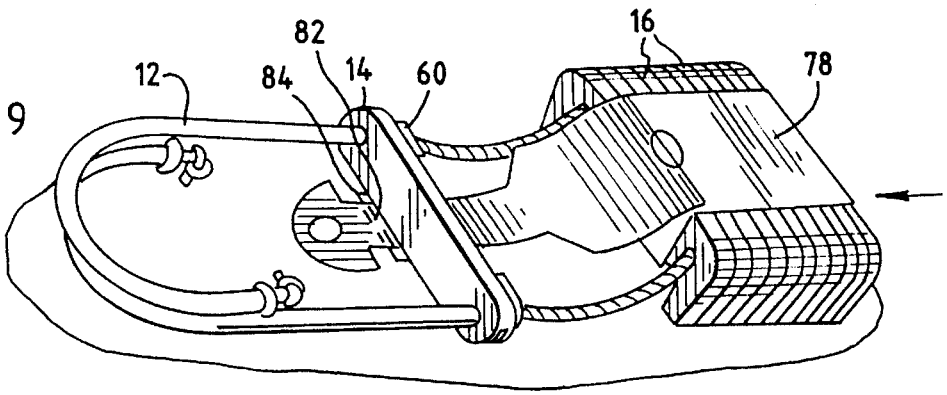

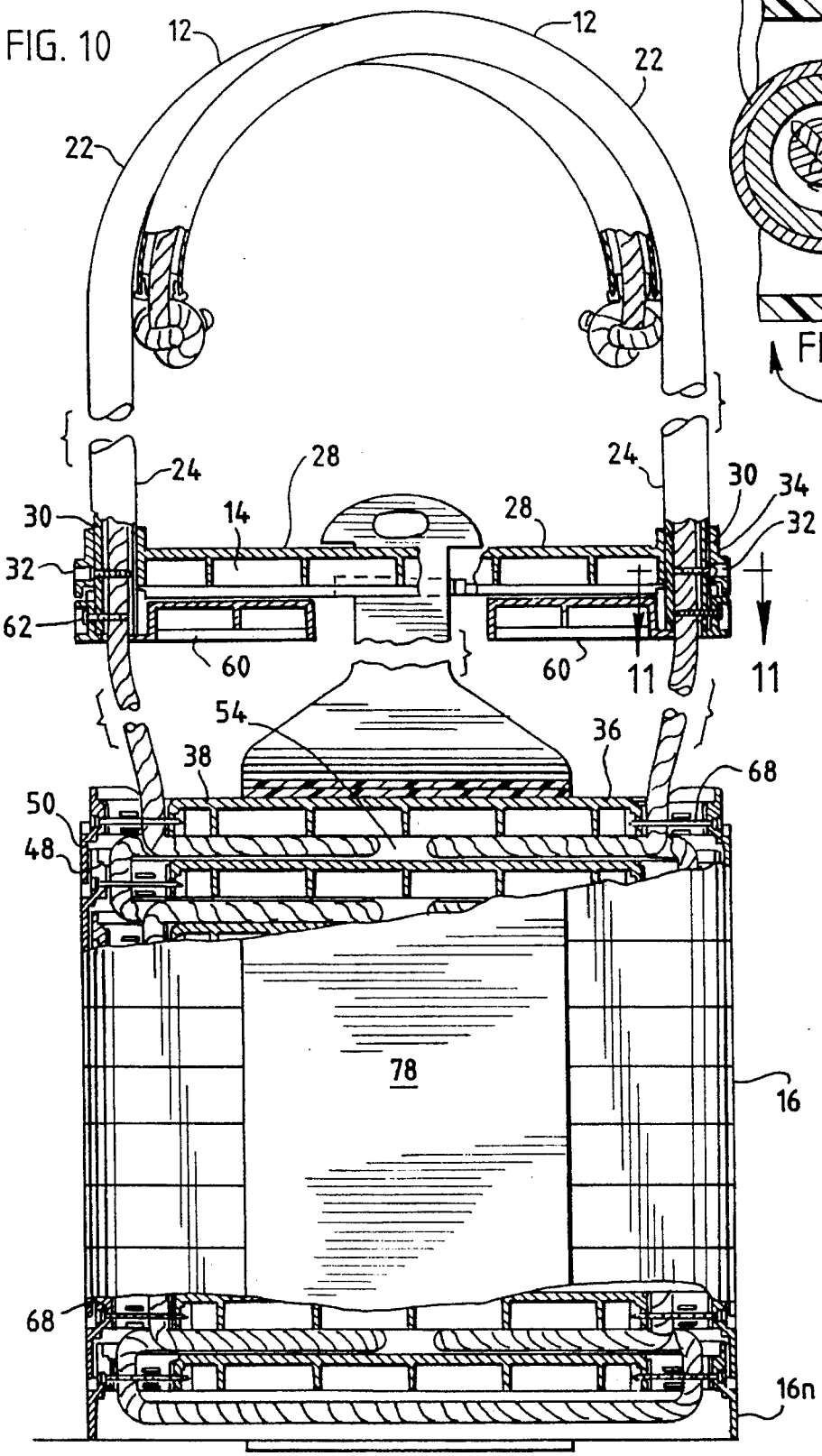
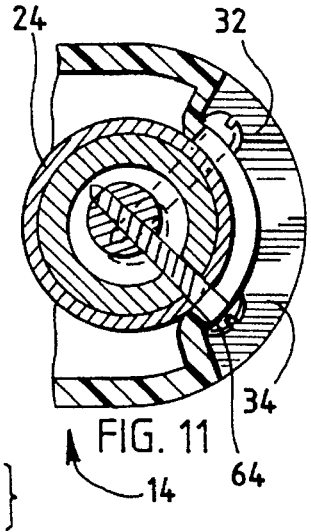
FIG. 11

READILY DEPLOYABLE PORTABLE ESCAPE LADDER

FIELD OF THE INVENTION

This invention relates to portable escape ladders and more particularly, readily deployable, portable escape ladders having nestable rungs.

BACKGROUND OF THE INVENTION

Numerous device are known for the detection of smoke and fire, and for the mitigation of the consequences of such an event. One such device is the portable escape ladder.

Portable escape ladders provide an egress or escape route from a burning building, such as a home. Although many of the other known devices, such as smoke and fire detectors, and fire extinguishers, are commonly found in homes to detect and to mitigate the possibly disastrous consequences of a fire, escape ladders are much less commonly found. The principal reason for the less commonly found escape ladder appears to be its difficulty of deployment and use.

One known type of portable escape ladder has tubular metal rungs which are connected by link-type chains extending the length of the ladder. Such a ladder may include standoffs at various selected rungs to displace the ladder from the house to permit proper foot placement on the rungs.

This type of ladder typically includes a pair of hooks to secure the ladder to, for example, a window sill for deployment. Such ladders, however, because they are formed of tubular members, have a small tread width which does not permit sure footing when in use.

Moreover, such ladders are typically stored in a rolled or bundled manner. In use, the hooks are placed over, for example, a window sill, and the ladder roll or bundle is lowered out of a window to extend to the ground elevation. Such a rolled or bundled configuration does not facilitate deployment and may, in fact, frustrate deployment and use.

Given that the ladder is intended to be used during a fire, a possibly life-threatening situation, ease of deployment and use is a very desirable attribute for such a device.

Another known type of escape ladder uses molded plastic rungs which are connected by rope or cable extending the length of the ladder. Such a ladder may also include standoffs at selected rungs to provide distance between the ladder and the building.

Although such ladders may provide "sure-footing" when in use, known ladders are, like the chain-link type ladders, stored in a rolled or bundled manner. Such storage may increase the possibility of tangling the ladder, and again frustrate deployment of the ladder and the escape effort.

It would therefore be desirable to have a portable escape ladder which is stored in a manner to permit rapid deployment and easy use during a stressful situation, such as a fire.

SUMMARY OF THE INVENTION

A light weight, portable escape ladder which can be hung on a surface from the side of a building, which embodies the present invention provides rapid deployment and easy use. Such a ladder includes rungs which are in a first, stacked or nested state when stored.

Such a ladder includes a hook which is engageable with the surface of the building and a flexible support element, such as a rope attached to the hooks. The hooks may be pivotable between a storage position and a deploying or engaging position.

A plurality of rungs is attached to the support element in spaced apart relation to one another. The rungs are stackable or nestable with at least an adjacent rung.

The ladder may also include a cover for holding the rungs in the nested state. The cover includes a handle which extends adjacent the hooks for releasing the hooks from the nested state to a second, extended state.

In one form, the rungs include at least one aligning projection formed thereon and a projection receiving portion formed therein. The rungs nest, one into the other to form a stacked orientation, with the projection of one rung coacting with an adjacent rung to maintain the rungs in the stacked orientation.

A method for deploying such a ladder includes disposing the hook portions into a deploying position, lowering the ladder in the nested state from a window, and securing the ladder to a window sill. The ladder is deployed by grasping and pulling on the releasing handle which releases the cover and permits the ladder to open to the extended state.

These and other aspects and attributes of the present invention will be discussed with reference to the following drawings and accompanying specification.

BRIEF DESCRIPTION OF THE DRAWINGS

FIG. 2 is a perspective view of the ladder of FIG. 1 being positioned against a side of a building;

FIG. 3 is a partial perspective view of the ladder of FIG. 2 showing a method of deploying the ladder;

FIG. 4 is a partial perspective view of the ladder of FIG. 3 showing the direction of travel of the rungs during deployment;

FIG. 5 is a perspective view of the ladder of FIG. 4 shown in an extended state;

FIG. 6 is a partial perspective view of the ladder showing the hooks being positioned to prepare the ladder to be placed in the nested state;

FIG. 7 is a partial perspective view of the ladder of FIG. 6 in the extended state;

FIG. 8 is a perspective view of the ladder of FIG. 7 showing the nesting of the rungs and placement of the cover thereon;

FIG. 9 is a perspective view of the ladder of FIG. 8 in the fully nested state;

FIG. 10 is a partial cross-sectional, elevational view of the ladder shown in the nested state;

FIG. 11 is a view taken along line 11—11 of FIG. 10;

DETAILED DESCRIPTION OF THE PREFERRED EMBODIMENT

Figure 1:
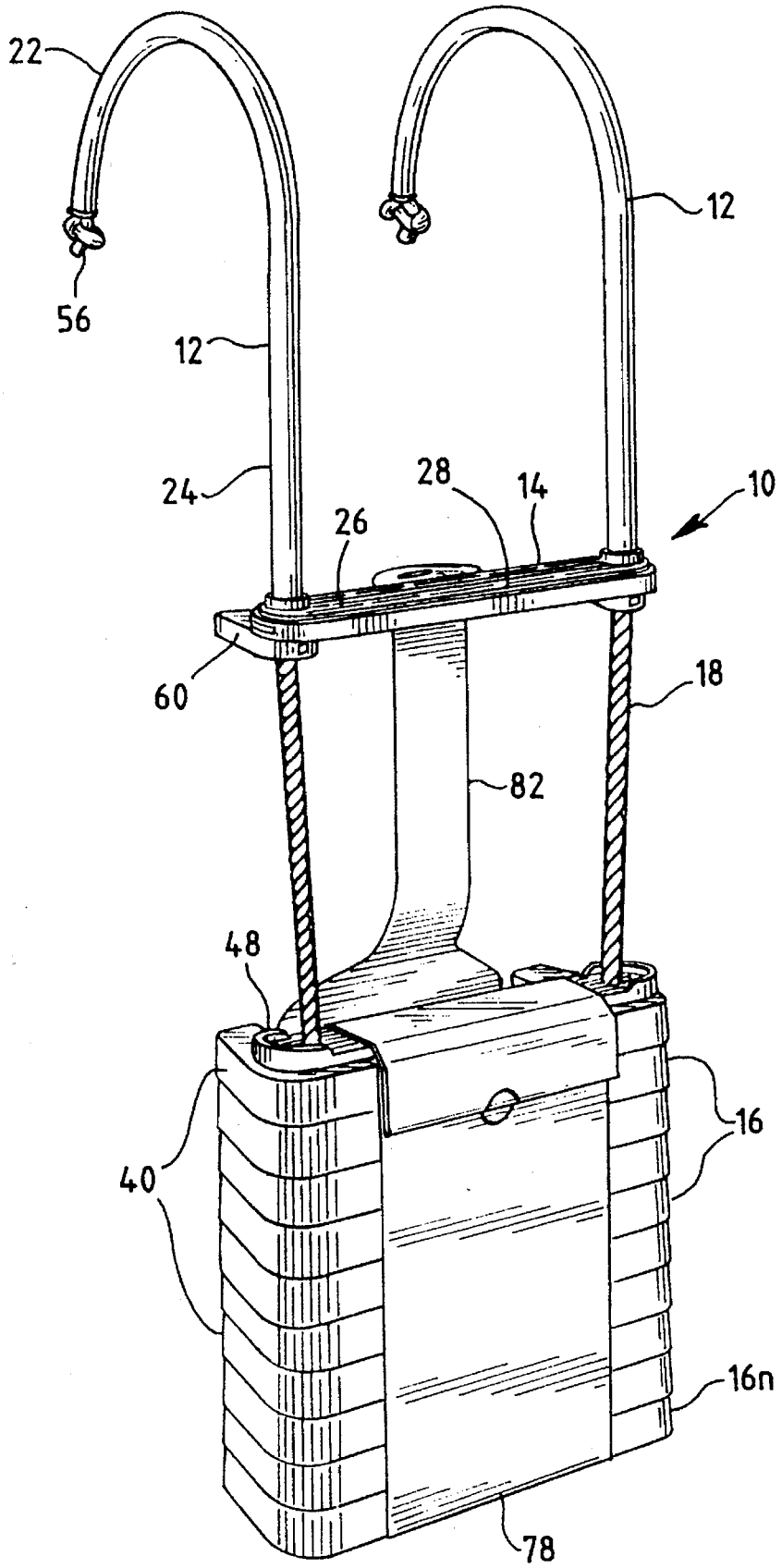
FIG. 1 is a perspective view of a readily deployable portable escape ladder which embodies the principles of the present invention, the ladder being shown prior to deployment.

While this invention is susceptible of embodiment in many different forms, there is shown in the drawings, and will be described herein in detail, a specific embodiment thereof with the understanding that the present disclosure is to be considered as an exemplification of the principles of the invention and is not intended to limit the invention to the specific embodiment illustrated.

With reference now to the drawings and particularly to FIG. 1, there is shown a portable, readily deployable escape ladder 10 embodying the present invention. The ladder includes a pair of hooks 12, a first stepping member 14, and a plurality of rungs 16. The ladder also includes an elongated, flexible support element 18 attached to the hooks and traversing the length of the ladder 10.

The hooks 12 are formed from a tubular member having a bore 20 therethrough. Each hook 12 includes a curvilinear or hooked portion 22, and a generally straight portion 24.

The stepping member 14 is an elongated, preferably molded element. The stepping member has a tread portion 26 or stepping surface along the top surface 28 thereof. The stepping member further defines a pair of bores 30 (best seen in FIG. 10) extending therethrough generally transverse to the plane of the member 14. Recesses 32 are formed in the sides 34 of the stepping member 14 which intersect the bores 30.

Figure 13:
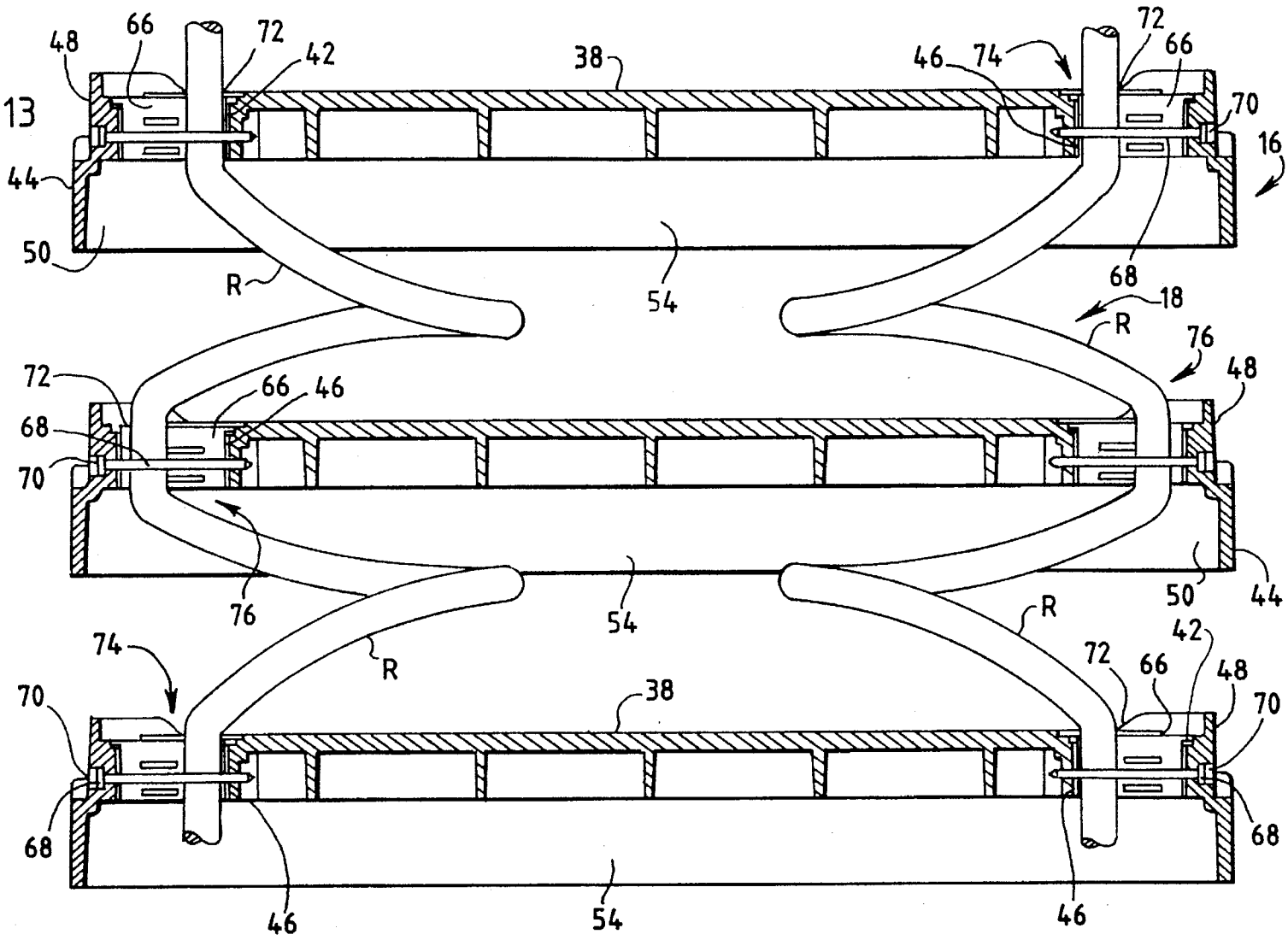
FIG. 13 is a partial cross-sectional, exploded view of a selected number of rungs of the ladder showing the flexible support member when the ladder is in a partially extended state.

Each of the rungs 16 is substantially identical, and includes a tread portion 36 or stepping surface along the top surface 38 thereof (best seen in FIG. 13). The rungs further include standoff elements 40 which are formed integral with the rung 16 and extend generally transverse thereto. Each rung 16 defines an elongated slot 42 at about each end 44 thereof which extends through the rung 16 (best seen in FIG. 13). The elongated slots are defined by a sleeve 46 which extends the thickness of the rung 16.

The rungs 16 include an aligning projection 48 which extends upwardly from about the tread portion 36 and is integral therewith. The rungs 16 also include an alignment receiving portion 50 in the bottom 52 thereof for receiving the projection 48 of an adjacent rung 16. This configuration allows the rungs 16 to be staked or nested one with the other, with the projection 44 of a rung 16 extending into and being received in the projection receiving portion 50 of an adjacent rung 16. This facilitates a neat, compact, stack arrangement of rungs 16 as shown in FIG. 10.

The rungs 16 are formed from a molding process, which produces an internal space 54 therein, which may form part of the projection receiving portion 50. The space or region 54 promotes ease of nesting.

The ladder 10 includes an elongated, flexible support element 18, such as a nylon rope or steel cable, which is attached to the hooks 12. In one embodiment, a one-piece nylon rope is used to secure the rungs 16 in spaced relation to each other and to the hooks 12.

In the embodiment of the ladder shown in the figures the rope 18 has a knot 56 formed in one end thereof and the rope 16 is threaded through the bore 20 of one of the hooks 12. The knot 56 engages the hook 12 at the curvilinear end 22 thereof.

The stepping member 14, which may be a first rung, is assembled to the straight portion 24 of the hook 12 at about the end 58 thereof. A pivotable standoff member 60 is secured to the hook 12 at the straight end 58 thereof, adjacent to the stepping member 14, as shown in FIG. 10. The pivotable standoff member 60 is secured to the hook 12 by a fastener 60, such as a screw.

In this configuration, with the hook 12 and pivotable standoff member 60 fastened together, both the hook 12 and standoff member 60 conjointly pivot about the bore 60 in the stepping member 14. As best seen in FIGS. 10 and 11, which show the mounting details, the hook 12 and standoff 60 pivot about 90° between a first, storage position wherein the hook portions 22 are directed inwardly, and a second, engaging position. In the second position, the hook portions 22 are directed outwardly, such as to engage or secure to a windowsill. The engaging position of the hooks 12 is best seen in FIGS. 1 and 2.

The rotation of the hook 12 and standoff 60 are limited by a stop 64, for example, a screw, which is threaded into the hook straight portion 24 and which travels within the recess 32 in the side 34 of the stepping member 14. The limited rotation of the hooks 12 assures that the ladder 10 is properly positioned in the windowsill, with the standoffs 40 and 60 resting against the surfaces of the building, prior to deployment. The hooks 12 can be rotated only in one direction into the engaging position.

Figure 12:
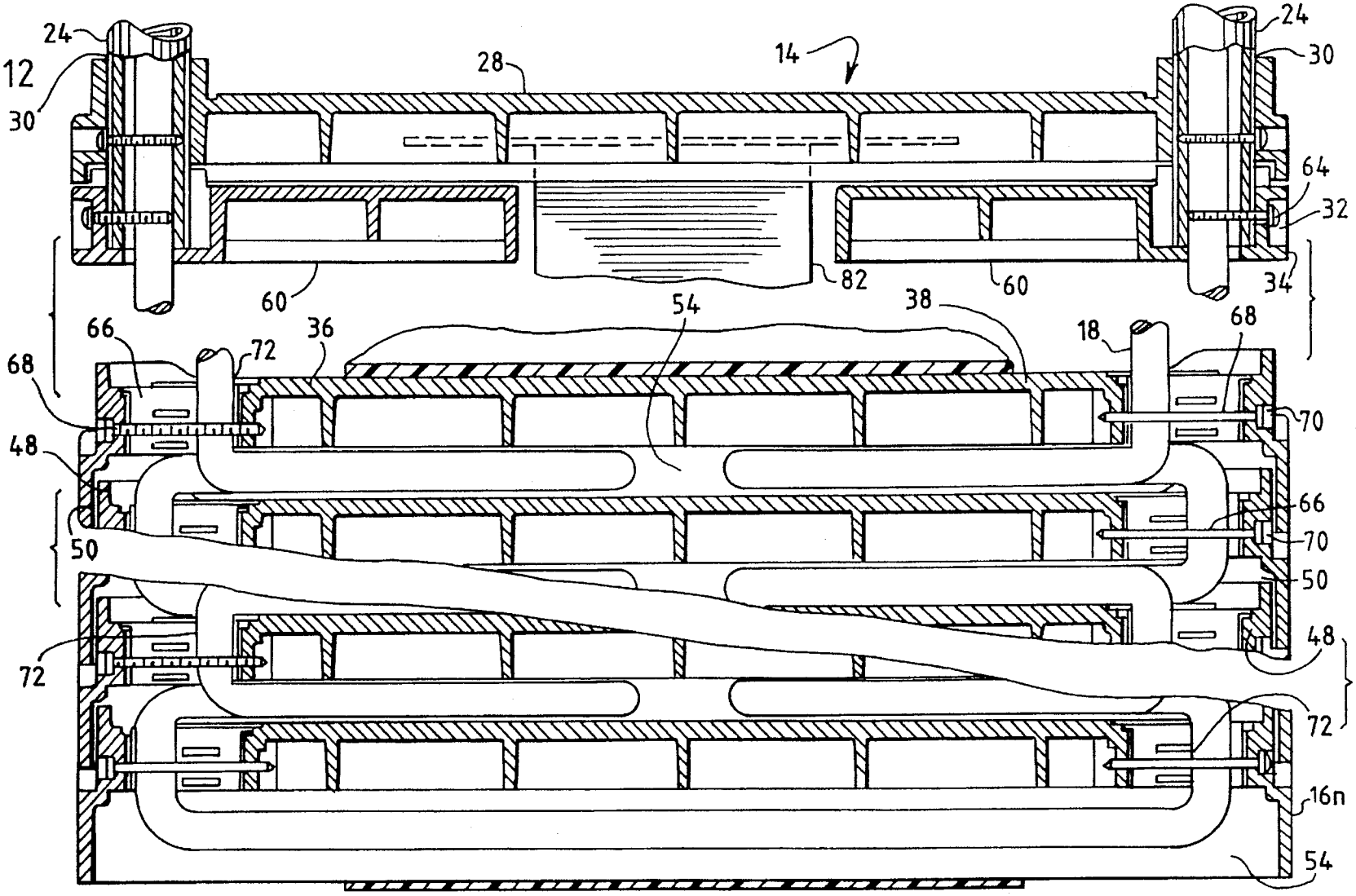
FIG. 12 is a partial cross-sectional view showing the top and bottom rungs of the ladder and a selected number of rungs therebetween in the nested state.

As shown in FIGS. 10 and 12, each rung 16 is secured or fastened to the rope 18 in spaced relation to each other rung 18 and to the stepping member 14. The rope 18 is threaded through the sleeve 46 formed by the elongated slot 42 in each rung 16. An insert or bearing 66 is positioned in the sleeve 46 and surrounds the rope 18. A fastener 68, such as a screw, is inserted into a recess 70 in the side of the rung 16, and is driven through the sidewalls of the sleeve 46, through the insert 66, and through the rope 18 to secure the rung 16 in place on the rope 18.

Figure 14:
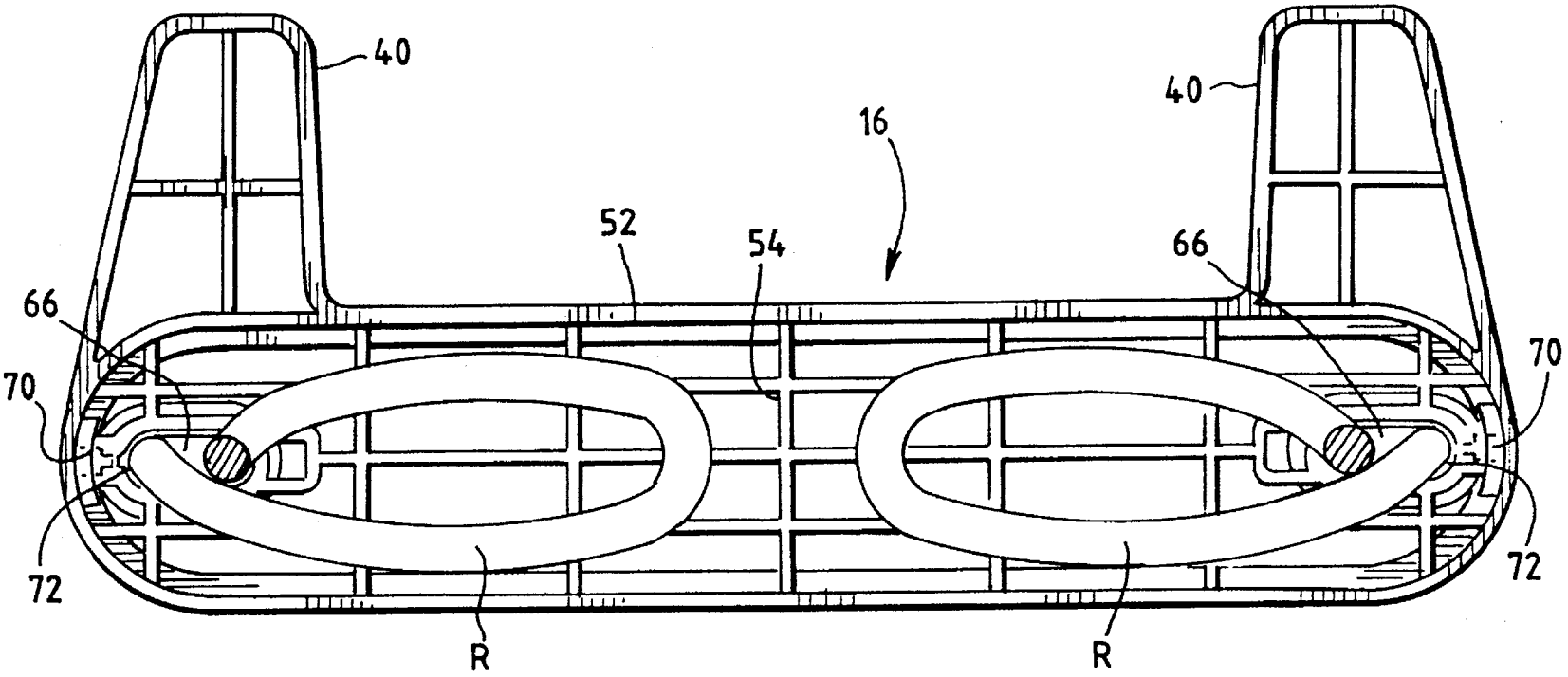
FIG. 14 is a bottom plan view of an exemplary rung, showing the flexible support member stored therein.

The insert 66, which is best shown in FIGS. 12–14, is an elongated element which is formed to fit into the sleeve 46. The insert 66 has an off-set bore 72 formed therethrough for receiving the rope 18. The insert 66 can be positioned so that the bore 72 is positioned inwardly (as shown at 74) or outwardly (as shown at 76) relative to the rung 16. When the ladder 10 is assembled, the inserts 66 are staggered, that is each insert 66 is positioned opposite (i.e., inwardly or outwardly oriented) relative to the insert 66 of the adjacent rung or rungs 16.

The rope 18 is threaded through and transverses each rung 16 and is secured to each rung as discussed above. As shown in FIG. 12, with respect to the bottom rung 16, the rope 18 transverses across the bottom thereof and is threaded upwardly back through the slot 42 in the opposite end of the rung 16.

The assembled ladder 10 is stored with the rungs 10 in the stacked, or nested orientation as shown in FIG. 1. With reference to FIGS. 11 and 12, in the nested orientation, the rope 18 which transverses between rungs 16 is stored in the interior space 54 provided in each rung 16. In this manner, and shown in FIG. 13, the discrete sections of rope (e.g., R) between each rung are kept separate, one from the other, which eliminates or reduces any possibility of tangling.

Referring to FIG. 12, the off-set location of the penetration of the rope 18 through each rung 16, which results from the use of staggered inserts 66, permits the rungs 16 to more easily nest, because the location of rope 18 penetration therethrough is displaced from the location of penetration in the adjacent rungs 16.

As shown in FIGS. 1 and 2, the ladder 10 also includes a cover 78 or storage wrap for retaining the rungs 16 in a stored state. In one embodiment, the wrap 78 is formed of a sheet member which substantially surrounds the rungs 16 when they are in the nested state. The wrap 78 also includes a mechanical hook and loop-type fastening system (such as Velcro®) 80 which retains the wrap 78 in place around the rungs 16.

Other fasteners such as snaps, buttons, zippers or ties, could be used without departing from the spirit and scope of the present invention. Similarly, the wrap or cover 78 could be formed of fabric or plastic sheet material without limitation.

The wrap 78 or cover may also include a handle portion 82 which extends upwardly from the nested or wrapped rungs 16 to the stepping member 14. The stepping member 14 may include a handle guide 84 which maintains the handle 82 in place for easy deployment of the ladder 10.

A ladder 10 which embodies the present invention is readily deployable in the event of a fire or other disaster wherein a quick and safe escape route is necessary. Referring now to FIGS. 2–7, after removing the ladder 10 from its storage location, the hooks 12 are pivoted outwardly to the engaging position.

The wrapped or covered rungs 16 are lowered out of a window, and the hooks 12 are secured to a windowsill. When the ladder 10 is in place against a surface of the building below the window, the releasing handle 82 is pulled toward the user as shown in FIG. 3, which disengages the fastener 80 securing the cover 78 around the rungs 16. When the cover 78 is released from the rungs 16, the ladder 10 extends to the extended or usable position from the force of gravity.

As best shown in FIGS. 6–9, the ladder 10 is readily repositioned into the nested state from the extended state. The ladder 10 is placed on a surface, and the hooks 12 are pivoted inward, toward each other. The nesting is more readily carried out with the ladder 10 positioned so that the standoffs 40 are against the surface.

The cover 78 is placed flat on the surface, and the ladder 10 is fully extended. Starting from the bottom rung 16, each rung 16 is moved forward toward the hooks and toward its adjacent rung 16. As shown in FIGS. 8 and 13, as the rungs 16 are moved toward the nested position, the portions of rope R between the to-be nested rungs 16 are directed inwardly and stored in the space 54 within the rungs.

When all of the rungs 16 are nested together, the cover 78 is wrapped around the rungs 16, as shown in FIG. 8, and secured, as shown in FIG. 9. The ladder 10 is now in the nested or stacked state.

The deployment method presented herein provides a safe and quick method of deploying an escape ladder 10, particularly during stressful situations such as a fire. The ladder 10 embodying the present invention provides a compact, storable, and readily deployable escape ladder 10 for use with minimal effort. The novel stacked or nested orientation of the rungs 16 minimizes any possibility that the rope 18 of the ladder will tangle with itself during deployment.

From the foregoing it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A light weight, portable, and storable ladder which can be hung on a surface of a window of a building, the ladder comprising:

a pair of hooks wherein said hooks each have a curved end engageable with the surface and a rigid spacing member displaced from said curved ends and extending between said hooks and wherein said spacing member defines a slot;

an elongated flexible support element attached to said hooks;

a plurality of rungs wherein each of said rungs is attached to said element in spaced apart relation to another of said rungs, wherein each of said rungs is nestable with at least an adjacent one of said rungs, wherein each of said rungs and an adjacent rung define an internal storage region therebetween when said rungs are in a nested state, and wherein a portion of said elongated flexible support element extending between each said rung and an adjacent rung is storable in said storage region when said rungs are in said nested state; and a cover for holding said rungs in said nested state, wherein said cover has an elongated releasing handle with a neck portion which extends through said slot from said cover toward said curved ends, and wherein said handle is linearly movable in said slot to release said cover from said rungs and to permit the ladder to self-deploy to the extended state.

2. The ladder as in claim 1 wherein each said rung includes a flat stepping surface bounded by only first and second spaced apart borings therethrough, said borings configured for receiving said flexible support member.

3. The ladder as is claim 1 further wherein said spacing member includes a flat stepping surface bounded by first and second borings therethrough wherein said borings are configured for receiving said flexible support member.

4. The ladder as in claim 1 wherein each said rung includes a first and second spaced apart standoff elements.

5. The ladder as in claim 1 wherein said cover includes a fastening system for securing said cover to said rungs when in said nested state, and wherein said fastening system is selected from a group consisting of a mechanical hook and loop system, buttons, and snaps.

6. The ladder as in claim 1 wherein said handle is formed with a flexible planar shape.

* * * * *